US009004285B2

(12) United States Patent
Tanaka et al.

(10) Patent No.: US 9,004,285 B2
(45) Date of Patent: Apr. 14, 2015

(54) CLASSIFYING APPARATUS, CLASSIFYING METHOD, AND METHOD FOR PRODUCING TONER

(75) Inventors: Tetsuya Tanaka, Shizuoka (JP); Hiroki Morioka, Shizuoka (JP); Kaoru Aoki, Shizuoka (JP); Makoto Hirai, Shizuoka (JP); Shinya Hanatani, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 434 days.

(21) Appl. No.: 13/254,505

(22) PCT Filed: Mar. 2, 2010

(86) PCT No.: PCT/JP2010/053722

§ 371 (c)(1),
(2), (4) Date: Sep. 2, 2011

(87) PCT Pub. No.: WO2010/101270

PCT Pub. Date: Sep. 10, 2010

(65) Prior Publication Data

US 2011/0315607 A1 Dec. 29, 2011

(30) Foreign Application Priority Data

Mar. 3, 2009 (JP) ..... 2009-049690
Jun. 8, 2009 (JP) ..... 2009-136774

(51) Int. Cl.
*B07B 7/08* (2006.01)
*B07B 4/02* (2006.01)
(Continued)

(52) U.S. Cl.
CPC . *B07B 4/02* (2013.01); *B07B 7/083* (2013.01); *B07B 9/02* (2013.01); *G03G 9/0817* (2013.01); *B07B 4/025* (2013.01)

(58) Field of Classification Search
CPC ..... B07B 7/08; B07B 7/083
USPC ..... 209/138, 139.1, 142, 143, 154, 713, 209/718, 720; 95/270; 55/400
See application file for complete search history.

(56) References Cited

U.S. PATENT DOCUMENTS 3,015,392 A * 1/1962 Rozsa et al. ..... 209/134
4,551,241 A * 11/1985 Saverse et al. ..... 209/135
(Continued)

FOREIGN PATENT DOCUMENTS

CN 1911522 A 2/2007
CN 101291747 A 10/2008
(Continued)

OTHER PUBLICATIONS

Extended European Search Report issued Jul. 30, 2013, in Patent Application No. 10748861.1.
(Continued)

*Primary Examiner* — Joseph C Rodriguez
(74) *Attorney, Agent, or Firm* — Oblon, McClelland, Maier & Neustadt, L.L.P.

(57) ABSTRACT

A classifying apparatus including: a rotor with a plurality of annularly disposed blades, which rotates; and a louver with a plurality of blades which are disposed at an outer circumferential portion of the rotor so as to supply from the outer circumferential portion a fluid for dispersing and classifying a powder material, wherein the powder material is supplied to a gap between the rotor and the louver and centrifugally classified into fine powder and coarse powder, and wherein at least one of the following relationships is satisfied: Relationship (1): $\alpha \geq 50°$ Relationship (2): $D2/D1 \geq 1.17$ where $\alpha$ denotes an angle formed between imaginary lines connecting the center of the rotor with both ends of each blade of the louver, D1 denotes a diameter of the rotor, and D2 denotes an inner diameter of the louver.

11 Claims, 5 Drawing Sheets

(51) Int. Cl.

| | |
|---|---|
| ***B07B 7/083*** | (2006.01) |
| ***B07B 9/02*** | (2006.01) |
| ***G03G 9/08*** | (2006.01) |

(56) References Cited

U.S. PATENT DOCUMENTS

| | | | | |
|---|---|---|---|---|
| 5,496,394 | A * | 3/1996 | Nied | 95/271 |
| 5,533,629 | A | 7/1996 | Ito et al. | |
| 7,364,101 | B2 | 4/2008 | Tanaka et al. | |
| 7,927,777 | B2 | 4/2011 | Kinoshita et al. | |
| 8,651,032 | B2 * | 2/2014 | Otani et al. | 110/232 |
| 2004/0253531 | A1 | 12/2004 | Ota et al. | |
| 2006/0063091 | A1 | 3/2006 | Makino et al. | |
| 2008/0290002 | A1 | 11/2008 | Strasser et al. | |

FOREIGN PATENT DOCUMENTS

| | | | |
|---|---|---|---|
| EP | 0 152 278 | A2 | 8/1985 |
| EP | 0 152 278 | A3 | 8/1985 |
| JP | 1 270982 | | 10/1989 |
| JP | 2 303560 | | 12/1990 |
| JP | 3 40787 | | 2/1991 |
| JP | 6 277629 | | 10/1994 |
| JP | 7 185465 | | 7/1995 |
| JP | 2662296 | B2 | 10/1997 |
| JP | 2000 296364 | | 10/2000 |
| JP | 2001 104888 | | 4/2001 |
| JP | 2001 293438 | | 10/2001 |
| JP | 2004-198640 | A | 7/2004 |
| JP | 2006 293268 | | 10/2006 |
| JP | 4010625 | | 11/2007 |
| JP | 2008 26457 | | 2/2008 |
| JP | 2008 161823 | | 7/2008 |
| JP | 2008 212810 | | 9/2008 |
| WO | WO 93/09883 | A1 | 5/1993 |

OTHER PUBLICATIONS

International Search Report Issued Jun. 15, 2010 in PCT/JP10/053722 filed Mar. 2, 2010.

Combined Chinese Office Action and Search Report Issued Apr. 2, 2013 in Patent Application No. 201080010359.7 (with English translation).

* cited by examiner

CLASSIFYING APPARATUS, CLASSIFYING METHOD, AND METHOD FOR PRODUCING TONER

TECHNICAL FIELD

The present invention relates to a classifying apparatus, a classifying method and a method for producing a toner, and specifically to a classifying apparatus, a classifying method and a method for producing a toner which are used to produce a dry toner for developing electrostatic images in electrophotography, electrostatic recording, electrostatic printing, etc. and which involve the sifting of particles to obtain particles having a desired diameter.

BACKGROUND ART

Conventionally, known classifying apparatuses include rotary mechanical classifying apparatuses for dividing micron-order powder material into coarse powder and fine powder. The rotary mechanical classifying apparatuses have a mechanism in which the powder material is centrifugally classified utilizing the centrifugal force of a rotating rotor. Each rotary mechanical classifying apparatus includes a rotor with a plurality of annularly disposed blades, which rotates; a louver with a plurality of blades which are disposed at an outer circumferential portion of the rotor so as to supply from the outer circumferential portion a fluid for dispersing and classifying a powder material; and a classification chamber having a shape based upon the cylindrical shape of the classifying apparatus, where the powder material supplied to a gap between the rotor and the louver is centrifugally classified into fine powder and coarse powder. Affected by the flow sucked from inside the rotating rotor with the plurality of annularly disposed blades and the flow of the rotating rotor, the powder material supplied to the classification chamber, which is the gap between the rotor and the louver, is divided into powder material led toward the inside of the rotor and powder material led toward the outside of the rotor, depending upon the balance of the force applied to powder particles, then discharged to a fine/coarse powder outlet, and thus classified into coarse powder and fine powder.

As to a conventional rotary mechanical classifying apparatus, the louver (6) in FIG. 1, described later, is not a specific louver employed in the present invention.

Continuous classification is possible in such a conventional rotary mechanical classifying apparatus. However, to separate powder of a desired particle diameter in the conventional rotary mechanical classifying apparatus, it is necessary to always provide the powder material with a uniform force balance in the classification chamber. In reality, though, it is difficult to provide each piece of the powder material with a uniform force balance, which is a cause of reduction in classification efficiency.

Examples of classifying apparatuses with improved classification efficiency include the rotary mechanical classifying apparatus disclosed in PTL 1. In this classifying apparatus, a classifying rotor in the form of an impeller is rotated, for example, around an axial core with respect to the perpendicular direction so as to swirl raw material powder, and classification air is blown from a classification space formed on the outer circumferential side of the classifying rotor toward the inside of the classifying rotor with respect to the radius direction, whereby fine powder in the raw material powder is carried by the flow of the classification air and passes through classifying blades because it is affected more by the conveying force of the airflow than by the centrifugal force related to the rotation, while coarse powder is thrust toward the outside and so cannot pass through the classifying blades because it is affected more by the centrifugal force related to the rotation, and thus the raw material powder is classified into fine powder and coarse powder.

Meanwhile, regarding the rotary mechanical classifying apparatus disclosed in PTL 2, there is proposed a classifier for toner, wherein the classifying rotor in the form of an impeller is coaxially placed in two places in one casing, raw material powder is sequentially passed through classification spaces on the outer circumferential side of the two classifying rotors, fine powder discharged from a fine powder outlet of the classifying rotor on the anterior side is designated as fine powder, fine powder discharged from a fine powder outlet of the classifying rotor on the posterior side is designated as middle-sized powder, coarse powder discharged from a coarse powder outlet is designated as coarse powder, thereby classifying the raw material powder such as toner into the three sections of fine powder, middle-sized powder and coarse powder, and the middle-sized powder is employed as a toner product.

However, regarding these classifying apparatuses, after the classification, coarse powder may be present among fine powder, or fine powder may be present among coarse powder, which leads to a decrease in classification accuracy and product yield, so that it is necessary to reduce the presence as much as possible.

In the rotary mechanical classifying apparatus disclosed in PTL 3, classifying blades of a classifying rotor are formed such that an outer end thereof with respect to the rotor diameter direction protrudes toward the outside with respect to the rotor diameter direction to a greater extent at the center than both ends thereof with respect to the rotor shaft direction. Regarding this structure, the outer end of the classifying blades, positioned at the center with respect to the rotor shaft direction, protrudes toward the outside with respect to the rotor diameter direction to a greater extent than the outer ends of the classifying blades, positioned at both ends with respect to the shaft direction; therefore, the circumferential speed becomes even higher, and thus the centrifugal force related to the rotation of the classifying rotor increases.

Specifically, an increase in the force of conveying coarse powder, which is due to the increase in airflow speed at the center with respect to the rotor shaft direction, is nullified by the increase in centrifugal force, so that coarse powder is prevented from thrusting from the outer circumferential side of the classifying rotor into the rotor, and thus the presence of coarse powder among fine powder discharged by suction from inside the rotor is restrained. It is alleged that a classifier is provided which is capable of restraining the presence of coarse powder among fine powder and thus improving classification accuracy and product yield; for example, in the case where fine powder is a product, the presence of coarse powder among fine powder is restrained so as to increase classification accuracy for fine powder; in the case where coarse powder is a product, the presence of coarse powder among fine powder is restrained so as to increase the product yield of coarse powder.

However, even when the classifying blades in the classifying apparatus are formed in the above-mentioned manner, only part of the centrifugal force slightly increases, which is insufficient for improvement in classification accuracy and product yield. This is because, in the classifier with the above-mentioned structure, fine powder is sucked together with air by a suction device or the like from inside the rotating classifying rotor, being sucked from one side inside the rotor, and thus there is a distribution of the speed of the air inside the rotor and the air sucked into the rotor from the classifying blades. Specifically, there is a distribution with respect to the width direction (the vertical direction in the case where the rotor is a longitudinally placed rotor) of the classifying blades, the effects thereof being uncertain. In other words, when powder material is classified utilizing the centrifugal force of air, what is important is a balance of the force applied from the air to the powder material; in the case of this classifier, the powder material is classified into coarse powder and fine powder according to the balance between the centrifugal force generated by the rotation of the rotor and the force of suction from inside the rotor. Therefore, regarding the structure disclosed in PTL 3, the balance between the powder material and the suction air is not considered, and this may lead to a further decrease in classification accuracy and product yield.

In PTL 3, as a fourth characteristic, provision of such a suitable embodiment of a classifier as follows is described: an annular classification space is formed between an outer circumferential surface of a classifying rotor and a guide blade ring with a plurality of annularly disposed guide blades, with a certain amount of space existing between the guide blades and the outer circumferential surface, a classification air supply unit for supplying classification air to the classification space through gaps between the adjacent guide blades of the guide blade ring is provided, raw material powder brought into a swirling state by the rotation of the classifying rotor reaches the annular classification space situated between the outer circumferential surface of the classifying rotor and the surrounding guide blade ring, fine powder is conveyed from the outer circumferential surface of the classifying rotor into the rotor by classification air supplied through the gaps between the adjacent blades of the guide blade ring, coarse powder is thrust away by classifying blades and thus not conveyed into the rotor but passes through the classification space, and it is thereby possible to increase classification accuracy and product yield further.

However, depending upon the structure of the above-mentioned guide blade ring, the distribution of speed related to centrifugal force may not be uniform in the space formed between the guide blade ring and the outer circumferential surface of the classifying rotor, coarse powder may not be thrust away by the classifying blades but conveyed into the rotor, which leads to a decrease in classification accuracy and product yield, and so there is room for improvement in the structure.

CITATION LIST

Patent Literature

[PTL 1] Japanese Patent Application Laid-Open (JP-A) No. 11-216425

[PTL 2] JP-A No. 2001-293438

[PTL 3] JP-A No. 2008-161823

SUMMARY OF INVENTION

Technical Problem

An object of the present invention is to solve the above-mentioned problems, achieve improvement in classification accuracy in a classification chamber of a classifying apparatus, and provide a classifying apparatus and a classifying method which are capable of highly efficiently separating particles of sizes in a required size range.

Solution to Problem

Specifically, the problems are solved by <1> to <5> below.

<1> A classifying apparatus including: a rotor with a plurality of annularly disposed blades, which rotates; and a louver with a plurality of blades which are disposed at an outer circumferential portion of the rotor so as to supply from the outer circumferential portion a fluid for dispersing and classifying a powder material, wherein the powder material is supplied to a gap between the rotor and the louver and centrifugally classified into fine powder and coarse powder, and wherein at least one of the following relationships is satisfied:

$\alpha \geq 50°$ Relationship (1):

$D2/D1 \geq 1.17$ Relationship (2):

where $\alpha$ denotes an angle formed between imaginary lines connecting the center of the rotor with both ends of each blade of the louver, D1 denotes a diameter of the rotor, and D2 denotes an inner diameter of the louver.

<2> The classifying apparatus according to <1>, wherein the blades of the louver are provided at regular intervals on a concentric circle, with a central shaft of the rotor situated at the center.

<3> The classifying apparatus according to <1> or <2>, wherein the blades of the louver are detachably mountable.

<4> The classifying apparatus according to any one of <1> to <3>, further including a regenerative converter, wherein the number of rotations of the rotor is controlled by the regenerative converter such that the number becomes a predetermined number of rotations.

<5> A classifying method including:

classifying a powder material, using the classifying apparatus according to any one of <1> to <4>.

<6> A method for producing a toner, including:

classifying a powder material, using the classifying apparatus according to any one of <1> to <4>.

Advantageous Effects of Invention

In the classifying apparatus of the present invention, since centrifugal force necessary for classification can be increased and uniform classification over the outer circumference of the rotor is enabled, it is possible to centrifugally classify powder material into coarse powder and fine powder in an efficient manner.

BRIEF DESCRIPTION OF DRAWINGS

In FIG. 5, the point 1 shows that there is no variation in starting torque. The broken line i shows that there is no variation in stalling torque. The broken line ii shows that there is no variation in rated torque. The broken line iii shows load torque. The points 2 show that the synchronous speed torques corresponding to set frequencies are zero. The points 3 show that the rated slips relative to the synchronous speeds corresponding to set frequencies are in the same range of 3% to 7%. The values of the frequencies "a (commercial frequency)", "b", "c", "d" and "e" satisfy the relationship a>b>c>d>e. The points A, B, C, D and E show changes with respect to the numbers of rotations and the torques corresponding to the frequencies a, b, c, d and e in the presence of the load torque.

DESCRIPTION OF EMBODIMENTS

Figure 1:
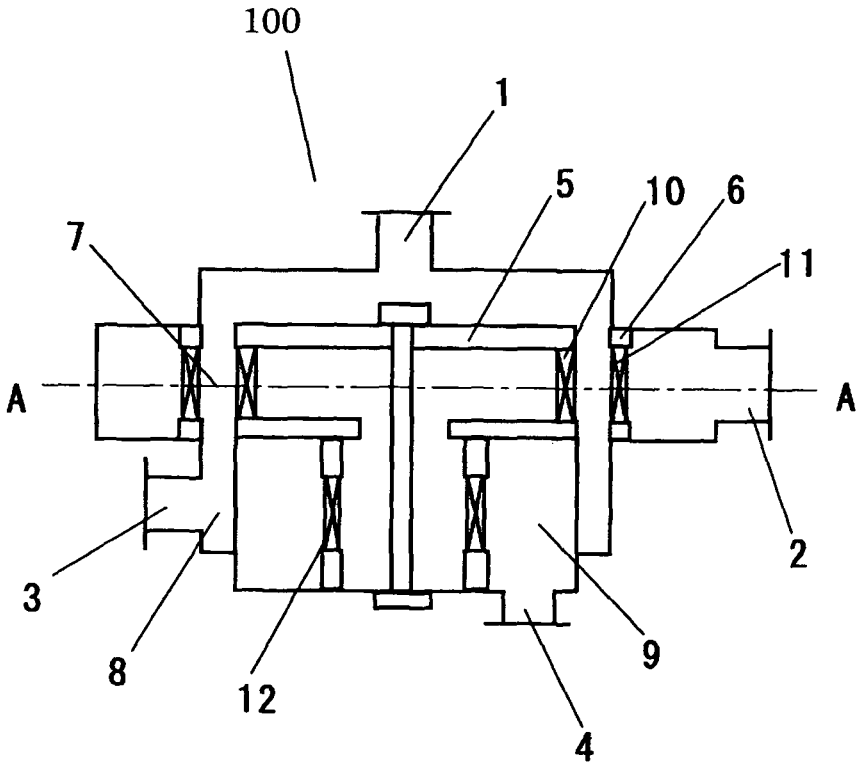
FIG. 1 is a schematic cross-sectional view showing an example of a classifying apparatus of the present invention.

An embodiment for carrying out the present invention will be explained below, referring to the drawings. Here, it is easy for persons skilled in the art to modify/correct the present invention in the scope of the claims so as to create other embodiments; it should be noted that the scope of the claims includes such modification/correction, and the following explains an embodiment of the present invention and is not intended to limit the scope of the claims.

A classifying apparatus of the present invention includes a rotor which rotates, a classification chamber in which to classify powder material supplied, and a louver with which to supply air to the classification chamber. Since the classifying apparatus of the present invention is thus constructed, pulverized material can be classified into coarse powder and fine powder in the classification chamber.

FIG. 1 schematically shows the classifying apparatus of the present invention. In FIG. 1, (1) denotes a powder material inlet through which powder material is supplied, (2) denotes a classification air inlet for efficiently classifying the supplied powder material, (3) denotes a coarse powder outlet through which coarse powder among the classified powder material is discharged, (4) denotes a fine powder outlet through which fine powder among the classified powder material is discharged, and (5) denotes a rotor. The classifying apparatus main body as a whole is formed of a substantially cylindrical housing.

As to the classifying apparatus shown in FIG. 1, a constant amount of powder material is supplied from the powder material inlet (1), then the supplied powder material is radially led from an upper surface of the rotor (5) to an outer circumferential portion of the rotor (5) and reaches a classification chamber (7). At this time, air for leading the supplied powder material to the classification chamber (7) is supplied from the classification air inlet (2). When suction is performed by a suction device (not shown) such as a suction fan, which communicates with the fine powder outlet (4), the supplied powder material moves toward the fine powder outlet (4) passing through a fine powder discharge chamber (9). At this time, fine powder having a particle diameter equal to or smaller than a desired particle diameter is discharged from the fine powder outlet (4) due to the rotation of the rotor (5), whereas powder material having a particle diameter greater than the desired particle diameter is led to the outside of the rotor (5) due to the centrifugal force of the rotor (5), passed through a coarse powder discharge chamber (8) and discharged from the coarse powder outlet (3). The amount of the powder material inside the classification chamber (7) decreases; accordingly, when powder material is supplied from the powder material inlet (1) and the amount of the powder material inside the classification chamber (7) is made constant, it is possible to perform continuous classification.

In the present invention, it is desirable that a louver (6) be provided at the outer circumferential portion of the rotor (5), a certain distance away from the rotor (5), under appropriate conditions. When the louver (6) is provided under appropriate conditions, not only does the centrifugal force applied to the powder material in the classification chamber (7) increase, but also uniform force can be given over the outer circumference of the rotor (5), so that the powder material can be centrifugally classified into coarse powder and fine powder in an efficient manner. The specific structure of the louver (6) will be later described.

The shapes of the classification chamber (7), the coarse powder discharge chamber (8) and the fine powder discharge chamber (9) are not limited; these members are generally circular in cross-sectional shape as seen from the rotor shaft direction but may be elliptical or polygonal in cross-sectional shape as seen from the rotor shaft direction. Nevertheless, these members are preferably circular in cross-sectional shape as seen from the rotor shaft direction, in view of swirling coarse powder centrifugally separated in a radial manner from the rotor (5) and efficiently collecting it without causing stagnation of the flow, preventing attachment of the powder material to the inside of the classifying apparatus caused by stagnation of the flow at the time of continuous operation, and facilitating the shaping.

Figure 2:
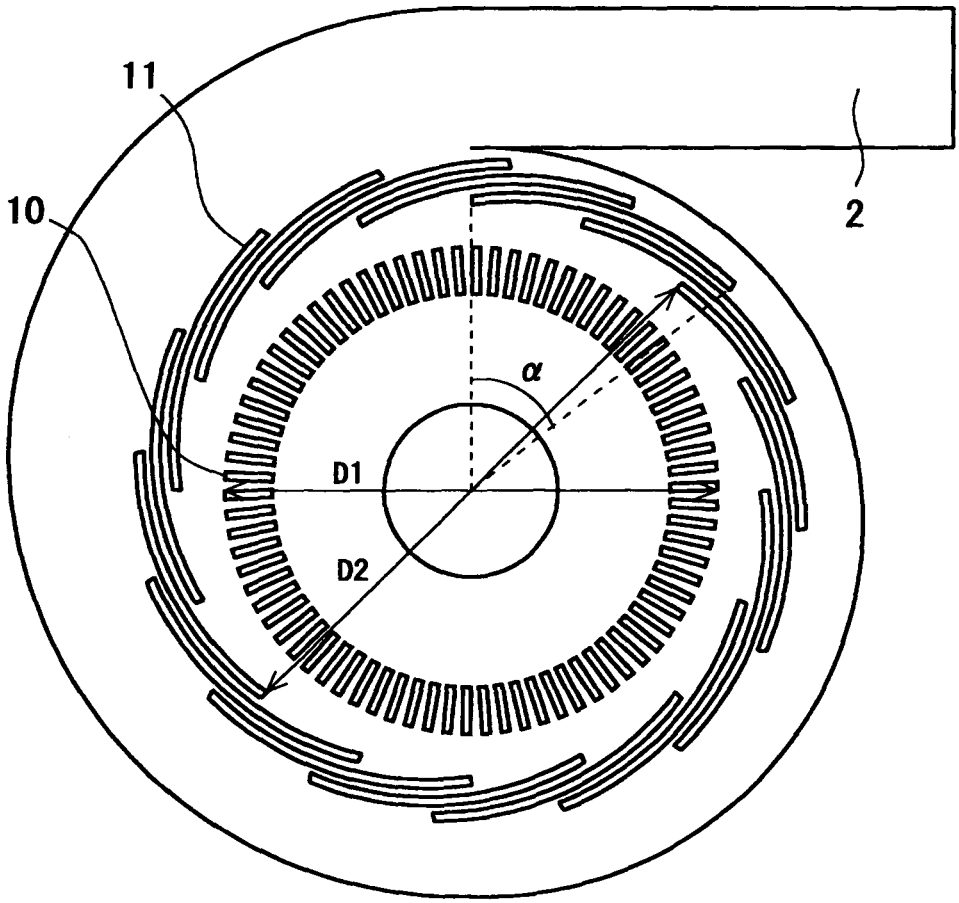
FIG. 2 is a cross-sectional view showing a louver in a classifying apparatus of the present invention.
Figure 3A:
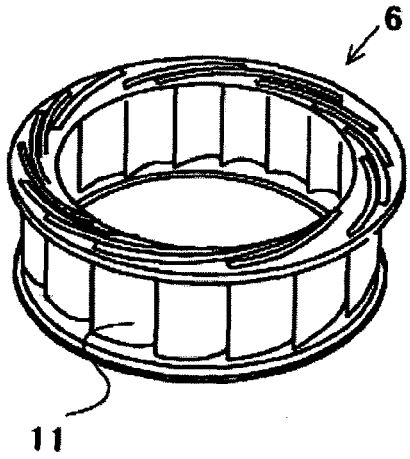
FIGS. 3A, 3B, 3C and 3D are structural drawings each showing part of a detachment mechanism of louver blades in a classifying apparatus of the present invention.
Figure 3B:
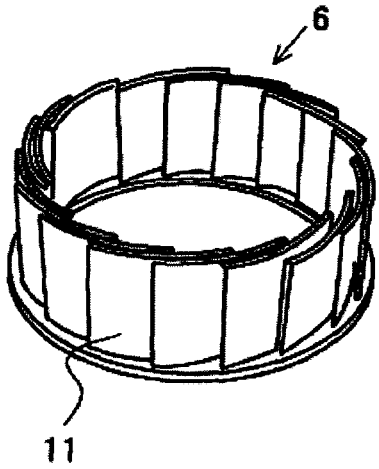
Figure 3C:
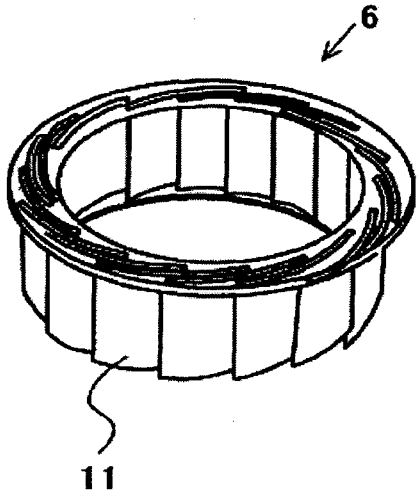
Figure 3D:
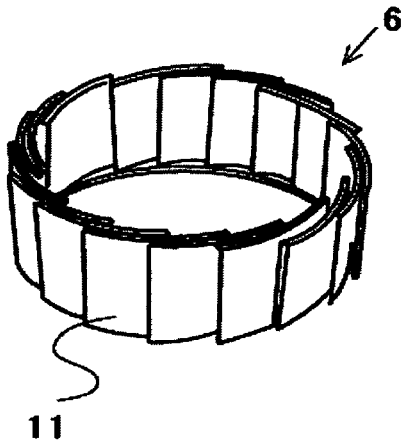

Next, the louver (6) in the classifying apparatus of the present invention will be specifically explained. FIG. 2 is a cross-sectional view of the classifying apparatus of the present invention, taken along the line A-A in FIG. 1. FIGS. 3A to 3D are structural drawings each showing part of a detachment mechanism of louver blades.

The louver (6) is formed by annularly arranging a plurality of louver blades (11) as shown in FIG. 2. Air supplied from the classification air inlet (2) keeps swirling and enters the classification chamber (7) through gaps between the louver blades (11), thereby having a function of promoting dispersion and classification of the powder material in the classification chamber (7). In FIG. 1, (10) denotes rotor blades, and (12) denotes fine powder discharging blades.

Also, as shown in FIG. 2, in the classifying apparatus of the present invention, at least one of the following relationships is satisfied, where $\alpha$ denotes an angle formed between imaginary lines (represented by the broken lines in FIG. 2) connecting the center of the rotor with both ends of each of the louver blades (11) constituting the louver (6) (hereinafter also referred to as "angle related to the length of the plurality of blades"), D1 denotes a diameter of the rotor (5), and D2 denotes an inner diameter of the louver (6).

$$\alpha \geq 50^\circ \qquad \text{Relationship (1):}$$

$$D2/D1 \geq 1.17 \qquad \text{Relationship (2):}$$

By constructing the louver (6) such that at least one of the above relationships is satisfied, the air supplied from the classification air inlet (2) is smoothly led to the space between the louver (6) and an outer circumferential surface of the rotor (5) and to the classification chamber (7), swirling and passing through the gaps between the louver blades (11) of the louver (6), and thus the airflow in the classification chamber (7) is not disturbed. As a result, it is not only possible to increase the speed of the flow in the classification chamber (7) but also to suppress disturbance in the speed distribution over the circumference of the rotor. Thus, centrifugal force necessary for classification can be increased, and further, uniform classification over the outer circumference of the rotor (5) is enabled, which makes it possible to centrifugally classify the powder material into coarse powder and fine powder in an efficient manner.

Note that D2/D1 preferably satisfies $1.17 \leq D2/D1 \leq 1.20$, more preferably $1.17 \leq D2/D1 \leq 1.19$, and that the upper limit of $\alpha$ is approximately 65°.

The louver blades (11) preferably have a thickness of 2 mm to 6 mm. When the louver blades (11) are too thick, the gaps between the louver blades (11) are narrow, the supplied air does not smoothly flow owing to pressure loss, the speed of the flow in the classification chamber (7) decreases, and thus there is a decrease in classification efficiency. When the louver blades (11) are too thin, not only does the mechanical strength of the louver (6) decrease, but also the surfaces of the louver blades (11) may be abraded at the time of continuous operation depending upon the constitution of the powder material, and thus there may be such a trouble that the louver blades are damaged.

The cross-sectional shape of the louver blades (11) is not limited; they are generally shaped like arcs in order to smooth the flow through the gaps between the louver blades (11), but they may be rectangular in shape. Also, it goes without saying that provision of a member such as the spiral member mentioned in PTL 3 causes no problem in particular.

The present inventors conducted a numerical analysis when either of the relationships $\alpha \geq 50°$ and $D2/D1 \geq 1.17$ was satisfied, where $\alpha$ denotes the angle related to the length of the plurality of blades constituting the louver (6), D1 denotes the diameter of the rotor (5), and D2 denotes the inner diameter of the louver (6). As a result, it was found that in the case where the louver (6) was provided, the average speed at the outer circumferential portion of the rotor (5) inside the classification chamber increased by approximately 10% or more, compared to a case where a louver with the relationships $\alpha=47°$ and $D2/D1=1.16$ was provided. Here, the average speed at the outer circumferential portion of the rotor (5) means the average airflow speed.

The results of experiments and numerical analyses conducted in the past by the present inventors had revealed the following: in a mechanism in which powder material is classified into coarse powder and fine powder utilizing the centrifugal force of a rotor as in the present invention, there is a clear improvement in classification efficiency when the speed related to the centrifugal force acting on the powder material increases by 10% or more. Hence, by satisfying at least one of the relationships $\alpha \geq 50°$ and $D2/D1 \geq 1.17$, whereby the average speed at the outer circumferential portion of the rotor (5) inside the classification chamber increases by 10% or more as compared to a conventional case, it is possible to make the classification efficiency higher than in the case of a conventional classifying apparatus.

The rotational circumferential speed of the rotor (5) is preferably 20 m/s to 70 m/s. When the rotational circumferential speed is in this range, desired classification efficiency can be obtained. When the rotational circumferential speed is lower than 20 m/s, there may be a decrease in classification efficiency. When the rotational circumferential speed is higher than 70 m/s, the centrifugal force generated by the rotor (5) is so great that powder material to be collected by a sucking unit may be led to the coarse powder outlet (3), and thus fine powder may not be separated.

Regarding the present embodiment, in the space formed between the louver (6) and the outer circumferential surface of the rotor for classification, since the louver blades (11) constituting the louver (6) enable the distribution of the speed related to the centrifugal force to be uniform and can increase the centrifugal force, the powder material can be centrifugally classified into coarse powder and fine powder in an efficient manner.

The louver blades (11) are preferably provided at regular intervals on a concentric circle with a central shaft of the rotor (5) situated at the center. Also, the louver blades (11) are preferably formed from 10 to 20 blades, more preferably 12 to 16 blades. The length of the gap between each louver blade is not particularly limited and may be suitably set.

Regarding the louver blades, the angle formed between imaginary lines connecting the center of the rotor with both ends of one louver blade may be different from, but is preferably the same as, the angle formed between imaginary lines connecting the center of the rotor with both ends of another louver blade.

Also, it is desirable that the louver blades be disposed consecutively and circularly and provided on the concentric circle with the central shaft of the rotor situated at the center, such that an end of one louver blade covers an end of another louver blade with the gap in between.

Further, as shown in each of FIGS. 3A, 3B, 3C and 3D, the louver blades (11) constituting the louver (6) are made detachably mountable. FIGS. 3A to 3D are structural drawings each showing part of a detachment mechanism of the louver blades in a state where it has been detached from the classifying apparatus.

Generally, when the classifying apparatus is continuously operated to classify powder material, the powder material may adhere to the surfaces of the louver blades (11), although the classification depends upon classifying conditions and the type of the powder material. If the adherence of the powder material proceeds, cleaning at the time when the powder material is changed is troublesome; moreover, the gaps between the louver blades (11) are narrowed owing to the adherence of the powder material, thereby causing pressure loss, so that the supplied air does not smoothly flow, the speed of the airflow in the classification chamber (7) decreases, and thus there may be a decrease in classification efficiency. Accordingly, by making the louver blades (11) detachably mountable, it is possible to simplify the operation of cleaning off the attached powder material and thereby reduce the time spent on the cleaning, so that the total amount of time required at the time of a change in conditions shortens and thus it is possible to improve productivity.

In a classifying apparatus (100), control of the number of rotations of the rotor may become unstable as the airflow speed at the outer circumferential portion of the rotor (5) increases. Specifically, the rotational force of the rotor increases as the airflow speed at the outer circumferential portion of the rotor increases, a regenerative current is generated as a motor becomes a generator owing to application of force greater than motor torque, and thus control of the number of rotations of the rotor may become unstable. In this case, the number of rotations of the rotor is controlled using a regenerative converter such that the number becomes a predetermined number of rotations.

Specifically, the regenerative converter is incorporated in a control circuit. Since the number of rotations of the rotor can be stably controlled by an inverter while the regenerative current generated from the motor is processed (the current is returned to a power supply), effectiveness can be obtained.

Figure 4:
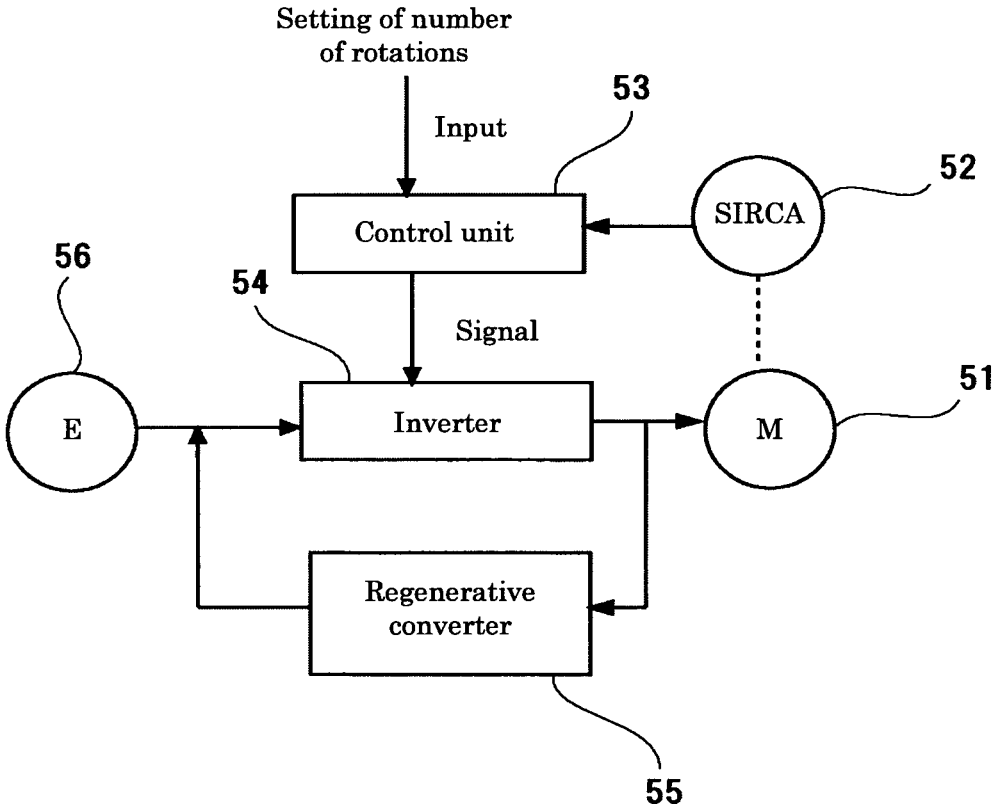
FIG. 4 is a diagram for explaining how a rotor for classification is controlled in a classifying apparatus of the present invention.

Here, control of the rotor for classification is explained with reference to FIG. 4. A rotation sensor (SIRCA) (52) is attached to a rotor driving electric motor (51) to detect the number of rotations of the rotor driving electric motor (51). Data for setting the number of rotations of the rotor for classification is input in a control unit (53), a frequency signal corresponding to the number of rotations is output to an inverter (54) with measurement of the difference from a signal coming from the rotation sensor (52), a drive current is output by the inverter (54), and the rotor driving electric motor (51) is thus rotated. A regenerative converter (55)

receives a regenerative current coming from the rotor driving electric motor (51) and returns it to an electric power supply (56).

The regenerative converter (55) is generally used to return to the electric power supply (56) a regenerative current generated when a classifying apparatus is decreased in speed or stopped. In the classifying apparatus of the present invention, however, a regenerative current is always generated in a normal operational state, so that the rotation is controlled by the inverter (54) while the regenerative current is processed.

Figure 5:
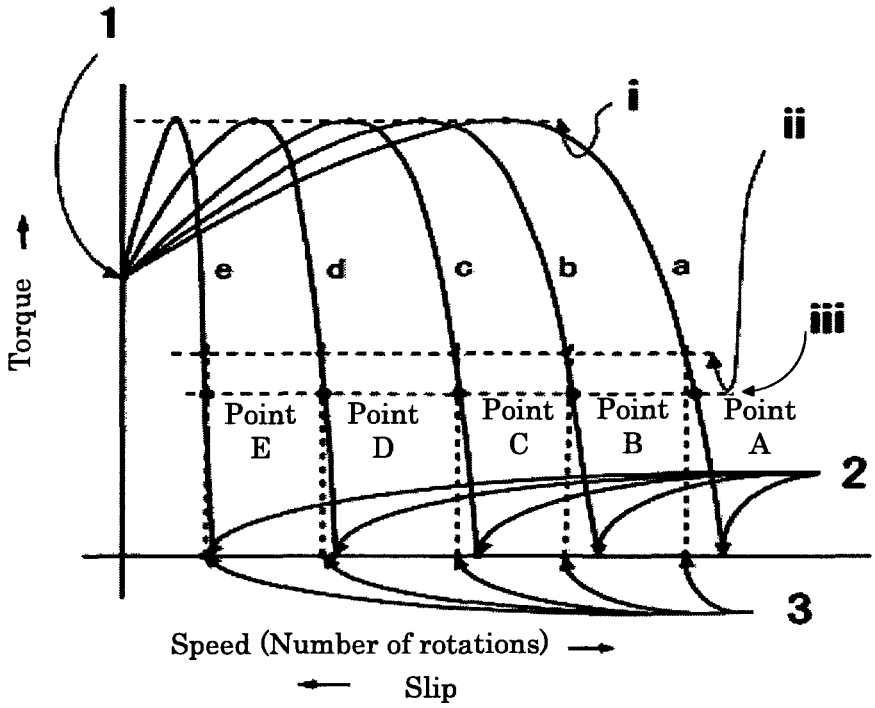
FIG. 5 is a diagram showing a rotation-torque characteristic of a rotor driving electric motor.

The number of rotations of the rotor driving electric motor can be changed by changing the frequency. FIG. 5 is a diagram showing a rotation-torque characteristic of the rotor driving electric motor. An inverter is used as a variable frequency power supply. When the number of rotations is equal to or greater than the number of rotations (synchronous speed) corresponding to a set frequency, the rotor driving electric motor becomes a generator and a regenerative current is generated.

The regenerative current is generated through a regenerative operation (state in which driving force is not applied) that takes place when a rotating object such as a rotor for classification is stopped. As a method of processing the regenerative current, there is a method of releasing the regenerative current as heat by the use of a resistance or returning the regenerative current to a power supply by the use of a regenerative converter. Provided that an apparatus such as a mechanical classifier is used in the state specified by its maker, a regenerative operation does not take place and so a regenerative current is not generated, except at the time of stoppage. However, since the louver blades in the present invention are produced by modifying commercially available louver blades, the conditions employed are outside the range of use conditions expected by the maker, and thus a regenerative current is generated. The modified louver blades are characterized in that they can provide strong force for rotating the rotor, and the rotational force of the rotor increases due to a uniform distribution of airflow speed at the outer circumferential portion of the rotor and an increase in airflow speed.

A classifying method of the present invention includes classifying a powder material, using the above-mentioned classifying apparatus.

Regarding the classifying apparatus (100) and the classifying method, it is possible to improve classification efficiency by making a simple alteration to the constitution of the louver (6) that is a component of the classifying apparatus (100) and thus to highly efficiently classify particles of a desired diameter range with less error and favorable classification accuracy. Furthermore, the classifying apparatus (100) and the classifying method can be highly effectively applied to production of products in fine powder form which are some micrometers in particle diameter, for example resins, agricultural chemicals, cosmetics and pigments. In particular, they are suitable for the method for producing a toner, explained below.

(Method for Producing Toner)

A method of the present invention for producing a toner includes at least a classifying step, preferably includes a melt-kneading step and a pulverizing step and, if necessary, includes other step(s). The classifying step is performed using the above-described classifying apparatus of the present invention.

<Melt-Kneading Step>

The melt-kneading step is a step of mixing toner materials together and melt-kneading the resultant mixture in a melt-kneader. Suitable examples of the melt-kneader include uniaxial or biaxial continuous kneaders and batch kneaders using a roll mill. Suitable examples thereof include KTK-TYPE BIAXIAL EXTRUDER (manufactured by Kobe Steel, Ltd.), TEM-TYPE EXTRUDER (manufactured by TOSHIBA MACHINE CO., LTD.), KCK KNEADER (manufactured by ASADA IRON WORKS, CO., LTD.), PCM-TYPE BIAXIAL EXTRUDER (manufactured by IKEGAI IRON WORKS, LTD.) and CO-KNEADER (manufactured by BUSS AG). This melt-kneading is preferably performed under appropriate conditions so as not to bring about cleavage of molecular chains of a binder resin. Specifically, the temperature at which the melt-kneading takes place is decided considering the softening point of the binder resin. When the temperature is far higher than the softening point, cleavage of the molecular chains occurs to a considerable extent. When the temperature is far lower than the softening point, dispersion of the ingredients may not sufficiently proceed.

The toner materials include at least a binder resin, a colorant, a release agent and a charge controlling agent and, if necessary, include other component(s).

—Binder Resin—

Examples of the binder resin include homopolymers and copolymers exemplified by styrenes such as styrene and chlorostyrene; monoolefins such as ethylene, propylene, butylene and isoprene; vinylesters such as vinyl acetate, vinyl propionate, vinyl benzoate and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone.

Very typical examples of the binder resin include polystyrene resins, polyester resins, styrene-acrylic copolymers, styrene-alkyl acrylate copolymers, styrene-alkyl methacrylate copolymers, styrene-acrylonitrile copolymers, styrene-butadiene copolymers, styrene-maleic anhydride copolymers, polyethylene resins and polypropylene resins. These may be used individually or in combination.

—Colorant—

The colorant is not particularly limited and may be suitably selected from known dyes and pigments according to the purpose. Examples thereof include carbon black, nigrosine dyes, iron black, Naphthol Yellow S, Hansa Yellow (10G, 5G, G), cadmium yellow, yellow iron oxide, yellow ocher, yellow lead, titanium yellow, polyazo yellow, oil yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazane Yellow BGL, isoindolinone yellow, red ocher, red lead, lead vermilion, cadmium red, cadmium mercury red, antimony vermilion, Permanent Red 4R, Para Red, Fire Red, p-chlor-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosin Lake, Rhodamine Lake B, Rhodamine Lake Y, Alizarine Lake, Thioindigo Red B, Thioindigo Maroon, oil red, quinacridone red, pyrazolone red, polyazo red, chrome vermilion, benzidine orange, perynone orange, oil orange, cobalt blue, cerulean blue, Alkali Blue Lake, Peacock Blue Lake, Victoria Blue Lake, metal-free phthalocyanine blue, phthalocyanine blue, Fast Sky Blue, Indanthrene Blue (RS, BC), indigo, ultramarine, Prussian blue, anthraquinone blue, Fast Violet B, Methyl Violet Lake, cobalt violet, manganese violet, dioxane violet, anthraquinone violet, chrome green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide and lithopone. These may be used individually or in combination.

The color of the colorant is not particularly limited and may be suitably selected according to the purpose. For example, a black colorant, a color colorant, etc. may be used. These may be used individually or in combination.

Examples of the black colorant include carbon blacks (C.I. Pigment Black 7) such as furnace black, lamp black, acetylene black and channel black; metals such as copper, iron (C.I. Pigment Black 11) and titanium oxide; and organic pigments such as aniline black (C.I. Pigment Black 1).

Examples of color pigments for magenta include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209 and 211; C.I. Pigment Violet 19; and C.I. Vat Red 1, 2, 10, 13, 15, 23, 29 and 35.

Examples of color pigments for cyan include C.I. Pigment Blue 2, 3, 15, 15:1, 15:2, 15:3, 15:4, 15:6, 16, 17 and 60; C.I. Vat Blue 6; C.I. Acid Blue 45, copper phthalocyanine pigments each having as substituent(s) one to five phthalimidemethyl groups on the phthalocyanine skeleton, Green 7 and Green 36.

Examples of color pigments for yellow include C.I. Pigment Yellow 1, 2, 3, 4, 5, 6, 7, 10, 11, 12, 13, 14, 15, 16, 17, 23, 55, 65, 73, 74, 83, 97, 110, 151, 154 and 180; C.I. Vat Yellow 1, 3 and 20, and Orange 36.

The amount of the colorant contained in the toner is not particularly limited and may be suitably selected according to the purpose. The amount thereof in the toner is preferably 1% by mass to 15% by mass, more preferably 3% by mass to 10% by mass. When the amount is less than 1% by mass, the coloring capability of the toner decreases. When the amount is more than 15% by mass, the pigment is poorly dispersed in the toner, possibly leading to a decrease in coloring capability and degradation of electrical properties of the toner.

The colorant may be compounded with a resin to form a masterbatch. The resin is not particularly limited and may be suitably selected from resins known in the art, according to the purpose. Examples thereof include styrene polymers, polymers of substituted styrene, styrene copolymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylic acid resins, rosin, modified rosin, terpene resins, aliphatic hydrocarbon resins, alicyclic hydrocarbon resins, aromatic petroleum resins, chlorinated paraffins and paraffins. These may be used individually or in combination.

Examples of the styrene polymers and the polymers of substituted styrene include polyester resins, polystyrene resins, poly-p-chlorostyrene resins and polyvinyltoluene resins. Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatch can be produced by mixing or kneading the colorant and the resin for use in a masterbatch with the application of high shearing force. In doing so, an organic solvent is preferably added to enhance interaction between the colorant and the resin. Also, use of the so-called flushing method is suitable in that a wet cake of the colorant can be used as it is, without the need to dry it. The flushing method is a method in which an aqueous paste containing a colorant is mixed or kneaded with a resin and an organic solvent and then the colorant is transferred to the resin to remove water and components of the organic solvent. For this mixing or kneading, a high-shearing dispersing apparatus such as a triple roll mill is suitably used.

—Release Agent—

The release agent is not particularly limited and may be suitably selected from release agents known in the art, according to the purpose. Examples thereof include waxes such as carbonyl group-containing waxes, polyolefin waxes and long-chain hydrocarbons. These may be used individually or in combination.

Examples of the carbonyl group-containing waxes include polyalkanoic acid esters, polyalkanol esters, polyalkanoic acid amides, polyalkylamides and dialkyl ketones. Examples of the polyalkanoic acid esters include carnauba wax, montan wax, trimethylolpropane tribehenate, pentaerythritol tetrabehenate, pentaerythritol diacetate dibehenate, glycerin tribehenate and 1,18-octadecanediol distearate. Examples of the polyalkanol esters include tristearyl trimellitate and distearyl maleate. Examples of the polyalkanoic acid amides include dibehenyl amide. Examples of the polyalkylamides include trimellitic acid tristearyl amide. Examples of the dialkyl ketones include distearyl ketone. Among these carbonyl group-containing waxes, polyalkanoic acid esters are particularly preferable.

Examples of the polyolefin waxes include polyethylene wax and polypropylene wax.

Examples of the long-chain hydrocarbons include paraffin wax and Sasol Wax.

The amount of the release agent contained in the toner is not particularly limited and may be suitably selected according to the purpose. The amount is preferably 0% by mass to 40% by mass, more preferably 3% by mass to 30% by mass. When the amount is greater than 40% by mass, the flowability of the toner may degrade.

—Charge Controlling Agent—

The charge controlling agent is not particularly limited and may be suitably selected from charge controlling agents known in the art, according to the purpose. Nevertheless, the material for the charge controlling agent is preferably colorless or whitish, since use of a colored material may cause a change in color tone. Examples of such colorless or whitish materials include triphenylmethane-based dyes, molybdic acid chelate pigments, rhodamine-based dyes, alkoxy amines, quaternary ammonium salts (including fluorine-modified quaternary ammonium salts), alkylamides, phosphorus, phosphorus-containing compounds, tungsten, tungsten-containing compounds, fluorine-based activators, metal salts of salicylic acid and metal salts of salicylic acid derivatives. These may be used individually or in combination.

The charge controlling agent may be a commercially available product. Examples thereof include BONTRON P-51 (quaternary ammonium salt), E-82 (oxynaphthoic acid-based metal complex), E-84 (salicylic acid-based metal complex) and E-89 (phenolic condensate) (which are manufactured by ORIENT CHEMICAL INDUSTRIES CO., LTD.); TP-302 and TP-415 (quaternary ammonium salt molybdenum complexes) (which are manufactured by HODOGAYA CHEMICAL CO., LTD.); COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salts) (which are manufactured by Hoechst AG); LRA-901, and LR-147 (boron complex) (which are manufactured by Japan Carlit Co., Ltd.); quinacridone, and azo-based pigments; and polymeric compounds containing a sulfonic acid group, a carboxyl group, a quaternary ammonium salt, etc.

The charge controlling agent may be dissolved or dispersed in the toner after melt-kneaded with the masterbatch, may be directly added to the organic solvent together with the components of the toner when dissolved or dispersed, or may be fixed on the surface of toner particles after the formation of the toner particles.

The amount of the charge controlling agent contained in the toner depends upon the type of the binder resin, the presence or absence of additive(s) and the dispersing process employed and therefore cannot be unequivocally defined. However, the amount is preferably 0.1 parts by mass to 10 parts by mass, more preferably 0.2 parts by mass to 5 parts by mass, per 100 parts by mass of the binder resin. When the amount is less than 0.1 parts by mass, favorable charge controlling properties may not be obtained. When the amount is greater than 10 parts by mass, the chargeability of the toner is so large that the effects of a main charge controlling agent are reduced, and the electrostatic attraction force between the toner and a developing roller increases, which possibly leads to a degradation of the flowability of a developer and/or a decrease in image density.

—Other Component(s)—

The above-mentioned other component(s) is/are not particularly limited and may be suitably selected according to the purpose. Examples thereof include an external additive, a flowability improver, a cleanability improver, a magnetic material and metal soap.

The external additive is not particularly limited and may be suitably selected from external additives known in the art, according to the purpose. Examples thereof include fine silica particles, hydrophobized fine silica particles, fatty acid metal salts (e.g. zinc stearate and aluminum stearate); metal oxides (e.g. titania, alumina, tin oxide and antimony oxide) and hydrophobized products thereof, and fluoropolymers. Among these, hydrophobized fine silica particles, titania particles and hydrophobized fine titania particles are particularly suitable.

<Pulverizing Step>

The pulverizing step is a step of performing fine pulverization using at least one pulverizer and, in some cases, employing at least one coarse powder classifying step. The pulverizer used in the pulverizing step is not particularly limited and may be suitably selected according to the purpose. Examples thereof include airflow pulverizers, fluidized-bed pulverizers and mechanical pulverizers.

Examples of the airflow pulverizers include ULTRASONIC JET PULVERIZER manufactured by Nippon Pneumatic Mfg. Co., Ltd., SUPER JET MILL manufactured by NISSHIN ENGINEERING INC. and MICRON JET manufactured by Hosokawa Micron Corporation.

Examples of the fluidized-bed pulverizers include COUNTER JET PULVERIZER manufactured by Hosokawa Micron Corporation and CROSS JET MILL manufactured by Kurimoto, Ltd.

Examples of the mechanical pulverizers include KRYPTRON manufactured by EARTH TECHNICA CO. LTD. SUPER ROTOR manufactured by NISSHIN ENGINEERING INC. and TURBO MILL manufactured by TURBO KOGYO CO., LTD.

(Toner)

A toner of the present invention is produced by the method of the present invention for producing a toner. The toner preferably contains fine powder having a particle diameter of 4.0 μm or less in an amount of 15% by number or less, more preferably 0% by number to 10% by number. Also, the toner preferably contains coarse powder having a particle diameter of 12.7 μm or greater in an amount of 5.0% by mass or less, more preferably 0% by mass to 2.0% by mass. Further, the volume average particle diameter of the toner is preferably 5.0 μm to 12.0 μm.

Here, the particle size distribution and the volume average particle diameter can, for example, be measured using a particle size measuring apparatus (COULTER COUNTER TA-II, COULTER MULTISIZER II or COULTER MULTISIZER III, manufactured by Beckman Coulter, Inc.).

EXAMPLES

The following explains Examples of the present invention. It should, however, be noted that the present invention is not confined to these Examples.

Example 1

In the present Example, a mixture of 85 parts by mass of styrene-acrylic copolymer resin and 15 parts by mass of carbon black is melt-kneaded and cooled. Subsequently, the mixture was coarsely pulverized using a hammermill to prepare a powder material, and the powder material was finely pulverized using a fluidized-bed pulverizer and then classified using the classifying apparatus shown in FIG. 1.

The louver (6) with the relationships $\alpha=45°$ and D2/D1=1.18, which relates to the louver shown in FIG. 2, was set in the classifying apparatus shown in FIG. 1, and the powder material was classified. Here, $\alpha$ denotes the angle related to the length of the plurality of blades, D1 denotes the diameter of the rotor (5), and D2 denotes the inner diameter of the louver (6). The louver blades (11) had a thickness of 4 mm and were formed from 16 blades, the rotational circumferential speed of the rotor (5) was set at 60 m/s, and the powder material was classified. As to coarse powder obtained, the volume average particle diameter was 6.8 μm, the fine powder content concerning powder of 4 μm or less in particle diameter was 7.3% by number, the coarse powder content concerning powder of 12.7 μm or greater in particle diameter was 0.0% by mass, and the proportion of the coarse powder after the classification to the powder material inserted, in other words the classification yield, was 60%. At this time, the average speed at the outer circumferential portion of the rotor (5) inside the classification chamber increased by 12%, compared to that in Comparative Example 1. The volume average particle diameter and the particle size distribution were measured as follows.

<Measurement of Volume Average Particle Diameter and Particle Size Distribution>

Examples of apparatuses for measuring the volume average particle diameter and the particle size distribution in accordance with the Coulter Counter method include COULTER COUNTER TA-II, COULTER MULTISIZER II and COULTER MULTISIZER III (all of which are manufactured by Beckman Coulter, Inc.). Here, the particle diameter and the particle size distribution were measured using COULTER MULTISIZER III.

Firstly, 0.1 mL to 5 mL of a surfactant (alkylbenzene sulfonate) was added as a dispersant into 100 mL to 150 mL of an electrolytic solution. Here, the electrolytic solution was a 1% (by mass) NaCl aqueous solution prepared using primary sodium chloride; for example, ISOTON-II (produced by Coulter Corporation) may be used. Secondly, 2 mg to 20 mg of a measurement sample (powder) was added. The electrolytic solution in which the sample was suspended was subjected to dispersion treatment for one minute to three minutes using an ultrasonic dispersing apparatus. The volume of the powder was measured by the apparatuses, using an aperture of 100 μm, and the volume distribution was calculated. Based upon the volume distribution obtained, the volume average particle diameter and the particle size distribution of the powder were calculated.

As channels, the following 13 channels were used, and particles having diameters which are equal to or greater than 2.00 μm but less than 40.30 μm were targeted: a channel of 2.00 μm or greater but less than 2.52 μm; a channel of 2.52 μm or greater but less than 3.17 μm; a channel of 3.17 μm or greater but less than 4.00 μm; a channel of 4.00 μm or greater but less than 5.04 μm; a channel of 5.04 μm or greater but less than 6.35 μm; a channel of 6.35 μm or greater but less than 8.00 μm; a channel of 8.00 μm or greater but less than 10.08 μm; a channel of 10.08 μm or greater but less than 12.70 μm; a channel of 12.70 μm or greater but less than 16.00 μm; a channel of 16.00 μm or greater but less than 20.20 μm; a channel of 20.20 μm or greater but less than 25.40 μm; a channel of 25.40 μm or greater but less than 32.00 μm; and a channel of 32.00 μm or greater but less than 40.30 μm.

Example 2

The powder material was classified in a manner similar to Example 1, using a classifying apparatus which was the same as the classifying apparatus in Example 1 except that the louver (6) with the relationships $\alpha$=45° and D2/D1=1.19 was installed, and setting the rotational circumferential speed of the rotor (5) at 60 m/s. As to coarse powder obtained, the volume average particle diameter was 6.8 μm, the fine powder content concerning powder of 4 μm or less in particle diameter was 7.7% by number, the coarse powder content concerning powder of 12.7 μm or greater in particle diameter was 0.0% by mass, and the proportion of the coarse powder after the classification to the powder material inserted, in other words the classification yield, was 64%. At this time, the average speed at the outer circumferential portion of the rotor (5) inside the classification chamber increased by 16%, compared to that in Comparative Example 1.

Example 3

The Powder Material was Classified in a Manner Similar to Example 1, using a classifying apparatus which was the same as the classifying apparatus in Example 1 except that the louver (6) with the relationships $\alpha$=50° and D2/D1=1.18 was installed, and setting the rotational circumferential speed of the rotor (5) at 60 m/s. As to coarse powder obtained, the volume average particle diameter was 6.8 μm, the fine powder content concerning powder of 4 μm or less in particle diameter was 9.4% by number, the coarse powder content concerning powder of 12.7 μm or greater in particle diameter was 0.0% by mass, and the proportion of the coarse powder after the classification to the powder material inserted, in other words the classification yield, was 70%. At this time, the average speed at the outer circumferential portion of the rotor (5) inside the classification chamber increased by 25%, compared to that in Comparative Example 1.

Example 4

The powder material was classified in a manner similar to Example 1, using a classifying apparatus which was the same as the classifying apparatus in Example 1 except that the louver (6) with the relationships $\alpha$=55° and D2/D1=1.18 was installed, and setting the rotational circumferential speed of the rotor (5) at 60 m/s. As to coarse powder obtained, the volume average particle diameter was 6.8 μm, the fine powder content concerning powder of 4 μm or less in particle diameter was 9.7% by number, the coarse powder content concerning powder of 12.7 μm or greater in particle diameter was 0.0% by mass, and the proportion of the coarse powder after the classification to the powder material inserted, in other words the classification yield, was 73%. At this time, the average speed at the outer circumferential portion of the rotor (5) inside the classification chamber increased by 27%, compared to that in Comparative Example 1.

Example 5

The powder material was classified in a manner similar to Example 1, using a classifying apparatus which was the same as the classifying apparatus in Example 1 except that the louver (6) with the relationships $\alpha$=60° and D2/D1=1.16 was installed, and setting the rotational circumferential speed of the rotor (5) at 60 m/s. As to coarse powder obtained, the volume average particle diameter was 6.8 μm, the fine powder content concerning powder of 4 μm or less in particle diameter was 8.1% by number, the coarse powder content concerning powder of 12.7 μm or greater in particle diameter was 0.0% by mass, and the proportion of the coarse powder after the classification to the powder material inserted, in other words the classification yield, was 67%. At this time, the average speed at the outer circumferential portion of the rotor (5) inside the classification chamber increased by 20%, compared to that in Comparative Example 1.

Example 6

The Powder Material was Continuously Classified in the same manner as in Example 1 except that the louver blades (11) were made detachably mountable. Subsequently, the louver (6) was cleaned, the type of the powder material was changed, and then continuous classification of the powder material was performed again. As a result, the time spent in cleaning the louver (6) was able to be reduced by approximately 50%, compared to that in Example 1.

Comparative Example 1

The powder material was classified in a manner similar to Example 1, using a classifying apparatus which was the same as the classifying apparatus in Example 1 except that the louver (6) with the relationships $\alpha$=45° and D2/D1=1.16 was installed, and setting the rotational circumferential speed of the rotor (5) at 60 m/s. As to coarse powder obtained, the volume average particle diameter was 6.8 μm, the fine powder content concerning powder of 4 μm or less in particle diameter was 9.0% by number, the coarse powder content concerning powder of 12.7 μm or greater in particle diameter was 0.0% by mass, and the proportion of the coarse powder after the classification to the powder material inserted, in other words the classification yield, was 52%.

The evaluation results concerning Examples and Comparative Example are shown in Table 1.

TABLE 1

| | α (°) | D2/D1 | Volume average particle diameter (μm) | Fine powder content concerning powder of 4 μm or less in particle diameter (% by number) | Coarse powder content concerning powder of 12.7 μm or greater in particle diameter (% by mass) | Classification yield (%) |
|---|---|---|---|---|---|---|
| Ex. 1 | 45 | 1.18 | 6.8 | 7.3 | 0 | 60 |
| Ex. 2 | 45 | 1.19 | 6.8 | 7.7 | 0 | 64 |
| Ex. 3 | 50 | 1.18 | 6.8 | 9.4 | 0 | 70 |
| Ex. 4 | 55 | 1.18 | 6.8 | 9.7 | 0 | 73 |
| Ex. 5 | 60 | 1.16 | 6.8 | 8.1 | 0 | 67 |
| Comp. Ex. 1 | 45 | 1.16 | 6.8 | 9.0 | 0 | 52 |

In the classifying apparatus of the present invention, as is evident from the above explanations, by constructing a louver so as to satisfy at least one of the relationships $\alpha \geq 50°$ and $D2/D1 \geq 1.17$, where α denotes the angle related to the length of the plurality of blades constituting the louver, D1 denotes the diameter of the rotor, and D2 denotes the inner diameter of the louver (6), air supplied from the classification air inlet is smoothly led to the space between the louver and the outer circumferential surface of the rotor and to the classification chamber, swirling and passing through the gaps between the blades of the louver, so that the airflow in the classification chamber is not disturbed, and it is possible to increase the speed of the flow in the classification chamber and suppress disturbance in the speed distribution over the circumference of the rotor. Hence, it is possible to increase centrifugal force necessary for classification, and further, to centrifugally classify powder material into coarse powder and fine powder in an efficient manner because uniform classification over the outer circumference of the rotor is enabled.

REFERENCE SIGNS LIST

1 powder material inlet
2 classification air inlet
3 coarse powder outlet
4 fine powder outlet
5 rotor
6 louver
7 classification chamber
8 coarse powder discharge chamber
9 fine powder discharge chamber
10 rotor blade
11 louver blade
12 fine powder discharging blade
51 rotor driving electric motor
52 rotation sensor
53 control unit
54 inverter
55 regenerative converter
56 electric power supply
100 classifying apparatus

The invention claimed is:

1. A classifying apparatus, comprising:

a rotor comprising a plurality of annularly disposed blades, which rotates; and a louver comprising a plurality of blades which are disposed at an outer circumferential portion of the rotor so as to supply from an outer circumferential portion a fluid for dispersing and classifying a powder material, wherein the powder material is supplied to a gap between the rotor and the louver and is centrifugally classified into a fine powder and a coarse powder, and wherein both of the following relationships is satisfied:

$\alpha \geq 50°$ Relationship (1):

$1.17 \leq D2/D1 \leq 1.20$ Relationship (2):

wherein

α denotes an angle formed between imaginary lines connecting the center of the rotor with both ends of each blade of the louver, D1 denotes a diameter of the rotor, and D2 denotes an inner diameter of the louver, and wherein the angle formed between imaginary lines connecting the center of the rotor with the respective ends of a three-layer overlapping portion of a first blade of said louver and two blades of said louver adjacent to said first blade is equal to or more than 5° and equal to or less than 15°.

2. The apparatus of claim 1, wherein the blades of the louver are provided at regular intervals on a concentric circle, with a central shaft of the rotor situated at the center.

3. The apparatus of claim 1, further comprising a regenerative converter, wherein a number of rotations of the rotor is controlled by the regenerative converter such that the number becomes a predetermined number of rotations.

4. A method for classifying a powder material, comprising:

providing a classifying apparatus as claimed in claim 1;

supplying the powder material;

leading supplied powder material to the outer circumferential portion of the rotor;

supplying, by use of the louver from the outer circumferential portion, the fluid for dispersing and classifying the powder material; and centrifugally classifying the powder material supplied to the gap between the rotor and the louver into the fine powder and the coarse powder.

5. A method for producing a toner, by classifying a powder material, comprising:

providing a classifying apparatus as claimed in claim 1;

supplying the powder material;

leading supplied powder material to the outer circumferential portion of the rotor;

supplying, by use of the louver from the outer circumferential portion, the fluid for dispersing and classifying the powder material; and centrifugally classifying the powder material supplied to the gap between the rotor and the louver into the fine powder and the coarse powder.

6. The apparatus of claim 2, further comprising a regenerative converter, wherein a number of rotations of the rotor is controlled by the regenerative converter such that the number becomes a predetermined number of rotations.

7. A method for classifying a powder material, comprising:

providing a classifying apparatus as claimed in claim 2;

supplying the powder material;

leading supplied powder material to the outer circumferential portion of the rotor;

supplying, by use of the louver from the outer circumferential portion, the fluid for dispersing and classifying the powder material; and centrifugally classifying the powder material supplied to the gap between the rotor and the louver into the fine powder and the coarse powder.

8. A method for classifying a powder material, comprising:

providing a classifying apparatus as claimed in claim 3;

supplying the powder material;

leading supplied powder material to the outer circumferential portion of the rotor;

supplying, by use of the louver from the outer circumferential portion, the fluid for dispersing and classifying the powder material; and centrifugally classifying the powder material supplied to the gap between the rotor and the louver into the fine powder and the coarse powder.

9. A method for producing a toner, by classifying a powder material, comprising:

providing a classifying apparatus as claimed in claim 2;

supplying the powder material;

leading supplied powder material to the outer circumferential portion of the rotor;

supplying, by use of the louver from the outer circumferential portion, the fluid for dispersing and classifying the powder material; and centrifugally classifying the powder material supplied to the gap between the rotor and the louver into the fine powder and the coarse powder.

10. A method for producing a toner, by classifying a powder material, comprising:

providing a classifying apparatus as claimed in claim 3;

supplying the powder material;

leading supplied powder material to the outer circumferential portion of the rotor;

supplying, by use of the louver from the outer circumferential portion, the fluid for dispersing and classifying the powder material; and centrifugally classifying the powder material supplied to the gap between the rotor and the louver into the fine powder and the coarse powder.

11. The apparatus of claim 1, wherein for Relationship (2), $1.17<D2/D1<1.19$.

* * * * *